3/11/80 XR 4,192,655

United States Patent [19]

von Linde

[11] 4,192,655

[45] Mar. 11, 1980

[54] PROCESS AND APPARATUS FOR THE CONVEYANCE OF REAL GASES

[75] Inventor: Robert von Linde, Gräefelfing, Fed. Rep. of Germany

[73] Assignee: Caloric Gesellschaft für Apparatebau m.b.H., Graefelfing, Fed. Rep. of Germany

[21] Appl. No.: 924,644

[22] Filed: Jul. 14, 1978

[30] Foreign Application Priority Data

Jul. 18, 1977 [DE] Fed. Rep. of Germany ..... 2732428
Jan. 24, 1978 [DE] Fed. Rep. of Germany ..... 2802881

[51] Int. Cl.[2] ..... F17D 3/00
[52] U.S. Cl. ..... 48/191; 48/196 R; 62/53; 62/87; 137/13
[58] Field of Search ..... 62/52, 53, 87; 137/13; 48/191, 196 R, 197 R

[56] References Cited

U.S. PATENT DOCUMENTS

| | | | |
|---|---|---|---|
| 3,068,659 | 12/1962 | Marshall, Jr. | 62/52 |
| 3,650,119 | 3/1972 | Sparling | 62/55 |
| 3,802,213 | 4/1974 | Ooka | 62/55 |
| 3,846,994 | 11/1974 | Reid | 48/191 |
| 3,990,256 | 11/1969 | May et al. | 62/55 |
| 4,024,720 | 5/1977 | Dimentberg et al. | 62/55 |

*Primary Examiner*—Ronald C. Capossela

[57] ABSTRACT

A method of conveying a gas such as natural gas over long distances through a pipeline having a number of sections in series with intermediate compressor stations the pressure and temperature of the gas at entry to each pipeline section being such that the drop in pressure of the gas in each pipe section creates a drop in gas temperature and this low temperature gas is used to recool the gas heated by compression before it enters the next pipeline section.

19 Claims, 8 Drawing Figures

PROCESS AND APPARATUS FOR THE CONVEYANCE OF REAL GASES

Figure 1:
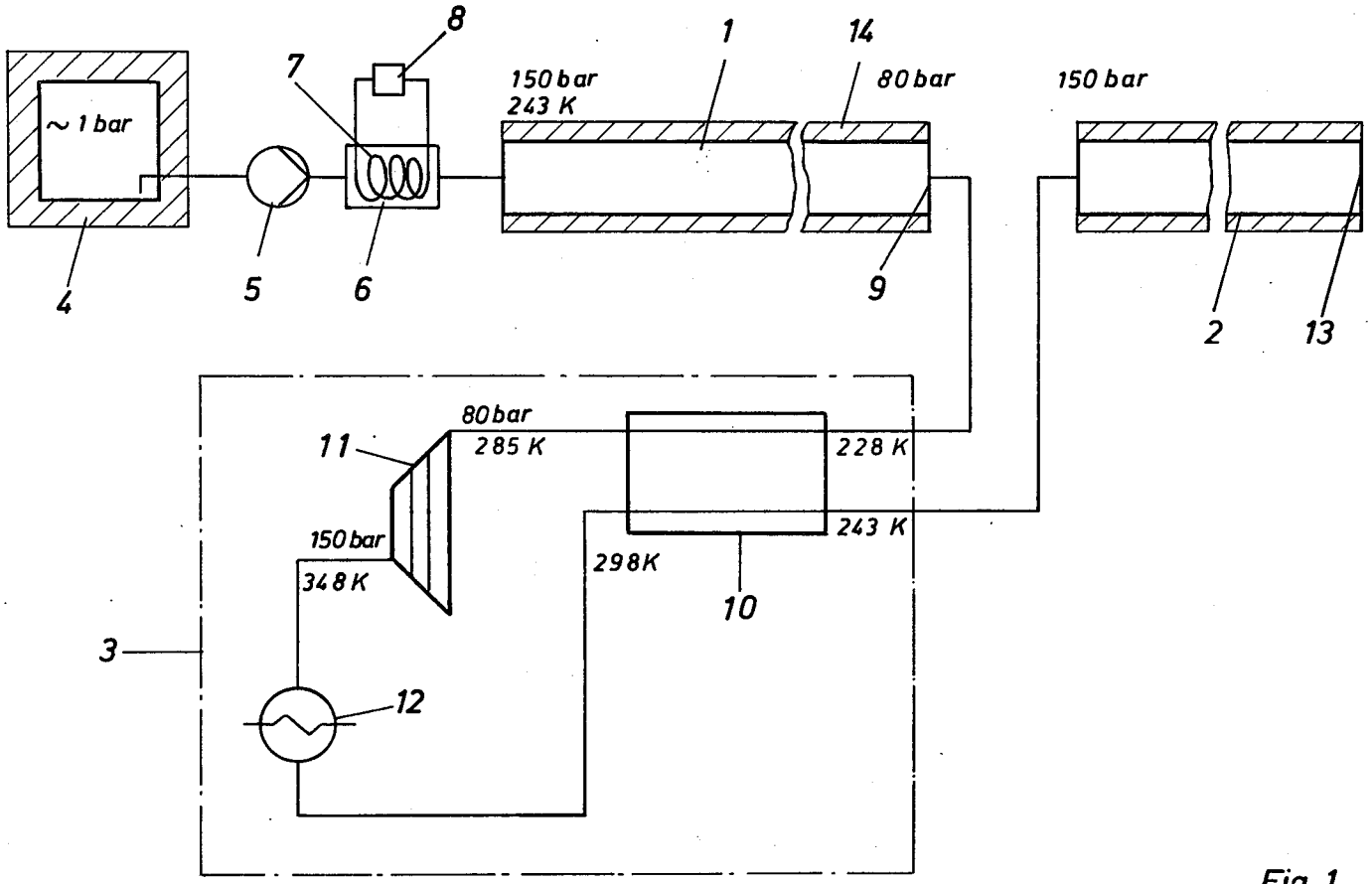

This invention relates to a process and a plant for the conveyance of real gases, more especially natural gas, over long distances by means of a pipeline comprising a number of sections connected in series, between which are provided compressor stations for balancing the loss of pressure in the preceding pipeline section.

In one existing long distance pipeline, the pressure reaches approximately 75 bars, for example, at the start of each pipe section, and approximately 50 bars at the end of the roughly 120 km long pipeline section. Before entry into the next pipe section, the gas pressure is again raised to 75 bars by two-stage radial compressors, which are driven by gas turbines. Conveyance takes place after the extraction of compression heat by cooling water roughly at ambient temperature, as the pipeline lies in the surrounding earth completely uninsulated against heat or insulated only slightly by linings providing protection againts corrosion. In calculations, it has, up to now, been generally assumed that under these conditions conveyance occurs isothermally, and that therefore no substantial temperature variations in the gas occur during conveyance.

Such pipeline equipment and associated compressor stations are exceptionally costly, not only with regard to the plant but also the running of it, as the energy required in each compressor represents a considerable proportion of the quantity of energy conveyed.

For these reasons much thought has been given as to how the conveyance of natural gas can be made more economical, either by making the pipeline installations and all the accessories cheaper, or by lower conveyance costs. Pipes of larger diameter, with which the loss of pressure might be reduced so that the compressor stations could be designed to be correspondingly smaller or located at larger spacings, unfortunately cost considerably more than the energy costs which are saved even over a long period of time, because of the lengths which are involved here.

Conveyance of natural gas in a liquefied state has already been considered (H. Laurien, "Taschenbuch Erdgas", Oldenburg-Verlag 1970, Pages 628 and 629). A reduction in the specific volume can be achieved, the result of which is that the capacity of the conveying pipeline, as compared with a gas pipe of the same diameter, is roughly 2 to 3 times as large, and the conveying energy which has to be used is considerably smaller, because of the smaller frictional losses. As can be gathered from the quoted literature reference, such pipelines have already been used for liquid natural gas over short distances. However with overland pipelines of hundreds or thousands of kilometers, these conceptions are impracticable when it is considered that a pipe of 100 km in length and a diameter of 48" has a wall area of approx. 300 000 $m^2$, which must be regarded as a heat exchange area through which the liquid natural gas is heated from the surroundings. As complete heat insulation is impossible, the liquid natural gas is very soon converted to the vapour state, thus defeating the main object. As can also be gathered from the aforementioned book, the specialist world is of the opinion that to lower the temperature brings no real advantages in the conveyance of natural gas, when liquefaction of the gas does not occur within an economical lowering of temperature.

That the specialist world see no decided advantages in the conveyance of cold gas can be attributed to the obvious reflection that the gas is considerably heated by intermediate compression which is unavoidable with long pipelines, and also a temperature reduction in the gas below about 293 K. cannot be achieved by use of cooling water behind the compressors, so that the use of refrigerating machines is necessary. The latter are not only very costly, but their energy requirement far exceeds the saving in energy which can be achieved by refrigerated conveyance.

The general object of the present invention is to provide for considerably more economical conveyance of real gases, especially natural gas, over long distances. The invention is based upon the conception that a pipeline without any external heat supply behaves thermodynamically like a throttle. Such throttling occurs with constant onthalpy. Whilst the temperature of an ideal gas does not vary during throttling, throttling of a real gas causes a temperature variation between the molecules, which is termed a Joule-Thompson effect, as a result of the Van der Waal's cohesion forces. This effect produces considerable cooling of the gas at certain pressures and temperatures. This condition is utilized in accordance with the invention for economical conveyance of natural gas, since the conveying capacity of a pipeline of a given diameter is considerably increased by conveyance at low temperatures because of the small specific volume.

Broadly stated the invention consists in a method of conveying real gases, more especially natural gas, over long distances by means of a pipeline having a plurality of sections connected in series, between which are provided compressor stations to compensate for the pressure loss in the preceding pipeline section in which the pressure and temperature of the gas at the start of each pipeline section are so selected that a lowering of gas temperature results from the drop in pressure in the pipe section, and this low temperature gas is used for re-cooling the gas heated by compression, before entry into the next pipeline section.

At the start of each pipeline section, the pressure is preferably between 75 and 150 bars and the temperature below 263 K. Particularly favourable conditions are produced at approximately 243 K.

As a result of the invention, it becomes possible to convey a low temperature-cooled and therefore correspondingly dense gas over long distances without any intermediate cooling by refrigerating machines, from which follows the additional advantage that by heating the gas before entry into the compressor, the demands on the strength of the material of the compressor can be reduced.

Contrary to current opinion, by selection of the correct pressure and temperature range notwithstanding the existance of frictional heat and the intake of some heat from the surroundings, not only does no heating of the gas occur, but there is actually a lowering of temperature, which is advantageously used in accordance with the invention, to cool the gas which is considerably heated by the following compression procedure and brought back to the initial pressure. This cooling procedure preferably takes place in a counter-current heat exchanger, through which flows cold gas from the incoming pipeline section and heated gas flowing from the compressor to the succeeding pipeline section. A gas cooler located preferably between the compressor and the heat exchanger conveys away most of the compression heat to a stream of water or air, and cools the gas to an intermediate temperature, from which it is then cooled in the counter-current heat exchanger to the desired temperature for entry into the succeeding pipeline section.

In order to obtain this reduction in temperature, the initial pressure and temperature in each pipe section must be so selected, that the incidence of heat from the surroundings must be somewhat overcompensated. This heat incidence is dependent upon the heat insulation of the pipe. This insulation is so designed according to a further proposal of the invention, that the heat incidence is smaller than half the enthalpy figure which would be necessary to annul the temperature reduction.

In order to be able to make the pipeline sections as long as possible and thereby be able to manage with fewer compressor stations, with the same pipe diameter for a given distance, it is advantageous to use compressors which have a pressure ratio of final pressure to entry pressure of at least 1.8. This pressure ratio may, for example, be obtained by means of two-stage, or better, three-stage radial blowers.

Since with falling pressure, the pressure losses per kilometer increase, it is advantageous if each pipeline section has a cross-section which increases with the increasing length. This can be achieved, for example, by gradual enlargement of the pipe diameter or by several pipes being connected in parallel, preferably in the last third of the pipeline section.

It can be seen that in the process of the invention, cooling of the gas by means of a refrigerating machine need only take place before entry of the gas into the first pipeline section, if the natural gas comes from a purification plant at approximately 293 K. No further refrigerating machine is then necessary over the entire course of the pipeline.

Even the refrigerating machine upstream of the first pipeline section can be omitted if the natural gas is already cold or in liquefied form, the latter being the case at most unloading points when tankers are used for transport. Here the liquid gas which is usually at atmospheric pressure, is raised to higher pressure, by means of a pump e.g. 50 to 150 bars, and heated to 243 K., for example, in an evaporator.

As the gas at the end of one pipeline section is already very cold and may have a temperature of, for example, 228 K. and lower, it can be liquefied at relatively small additional expense. This feature can be used to advantage when the gas is conveyed through a long pipeline to a port and then has to be loaded into tankers in liquefied form.

The arrangement can be so designed that the entry temperature of the gas into each pipeline section is the same, and therefore the gas in each intermediate station is cooled by the heat exchanger to a temperature which corresponds to the entry temperature of the gas into the next upstream pipeline section. The same ideal conditions can thereby be obtained over the entire length of the pipeline. This, however, requires comparatively large heat exchangers, especially if the latter are constructed as counter-current devices, as the temperature difference in each heat exchanger then becomes comparatively small. In order to make the process more economical, especially with regard to the capital expenditure which is to be entered into, it may be advantageous to design the process in such a way that the entry temperature of the re-cooled gas at the start of each succeeding pipeline section is higher than the entry temperature of the gas at the start of the next upstream pipeline section.

As a result of this, a considerably greater temperature difference prevails in the heat exchanger or in each heat exchanger, so that the dimensions of the heat exchanger can be correspondingly reduced. The temperature of the gas from pipeline section to pipeline section will actually be increased by this. This gradual rise in temperature need not affect the profitability of the gas conveyance, especially when a correspondingly low gas temperature at the start of the pipeline has been selected and/or the pipeline is only relatively short, for example, some 100 km long. Even with longer pipelines, however, there is still the possibility of bringing the gas back to a lower temperature level by intermediate cooling before entry into a pipeline section. Such re-cooling could take place at every intermediate station if costs of the heat exchanger which are saved by increasing the temperature difference in the heat exchanger are lower than the plants which are necessary for the re-cooling. This principle can also be used when the temperature of the gas at the start of each pipeline section is essentially the same.

An increase in the temperature difference in the heat exchanger can also be achieved in accordance with a further proposal of the invention, by admixing with the gas leaving one pipeline section and before heat absorption from the gas which is to be re-cooled, a partial current which is branched off from the re-cooled gas before entry into the downstream pipeline section, and is cooled below the exit temperature of the gas from the upstream-situated pipeline section.

The heat exchanger is preferably a counter-current heat exchanger, but a regenerative heat exchanger can basically also be used.

The additional heat removal after the gas leaves a heat exchanger and before entry of the gas into the downstream pipeline section can take place by means of a refrigerating machine, which is operated by the waste heat of the compressor. Alternatively an expansion machine can be provided, or if economic estimates permit it, a throttle with which a reduction in temperature by means of the Joule-Thompson effect is achieved.

Alternatively, an additional cooler can be located between the heat exchanger and the downstream pipeline section the cooling medium being a partial current, which is branched off from the gas leaving the cooler and is controlled by a throttle for the temperature reduction. If the compressor is driven by a gas turbine which obtains its supply gas from the upstream pipeline section, this partial current which is controlled before entry into the cooler by an expansion machine, a throttle or another temperature and pressure-reducing device, could also be used, so that with a pressure reduction of, for example, 80 bars to 3 bars, a temperature reduction of, for example 235 to 150 K. results.

In a construction in which a partial current of the re-cooled gas after heat removal is admixed with the gas leaving the upstream pipeline section, the heat removal can take place similarly by the aforementioned means, but preferably by means of a throttle, as in this partial current the profitability is not so important as the total capital expenditure.

Reduction of the size of the heat exchanger can also be achieved by conveying the gas through a cold water cooler, after flowing through the compressor and a normal cooler driven with line water, before entry into the heat exchanger, in which cold water cooler the cold water is preferably produced by means of the waste heat of the compressor or a gas turbine which drives the latter. A cold water cooler is a cooler in which the cooling medium is water cooled down to approximately 273–278 K.

Figure 6:
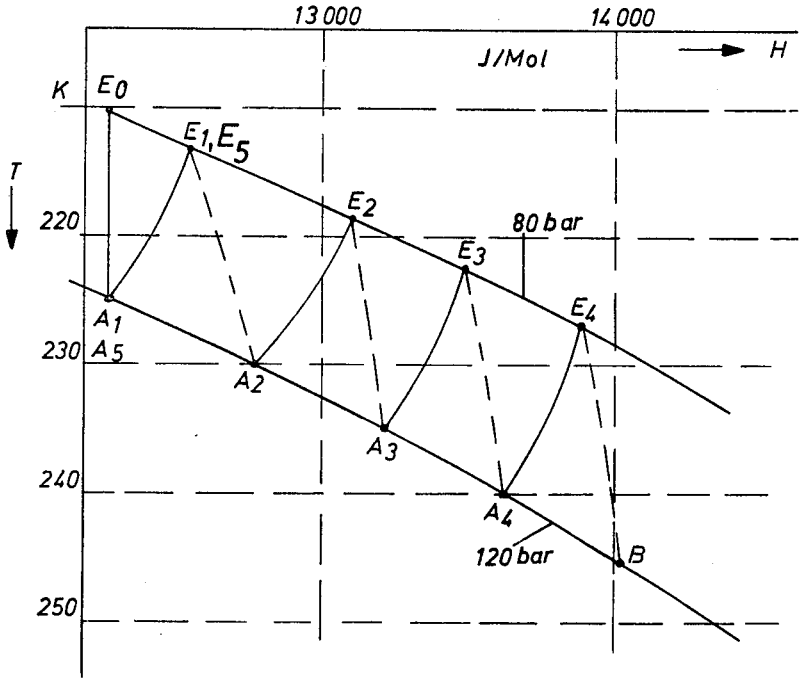
Figure 2:
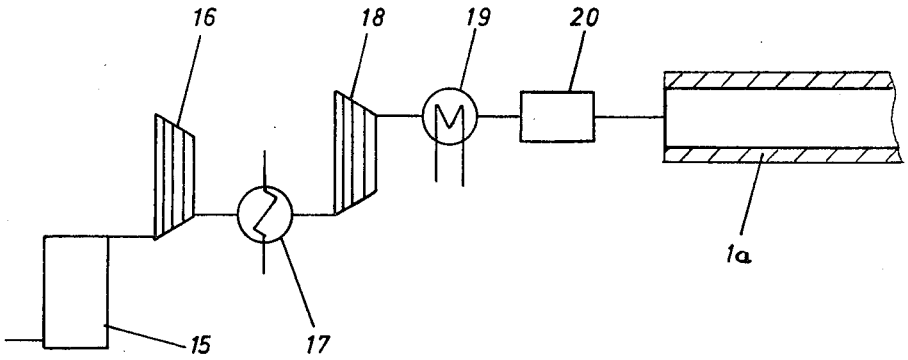
Figure 3:
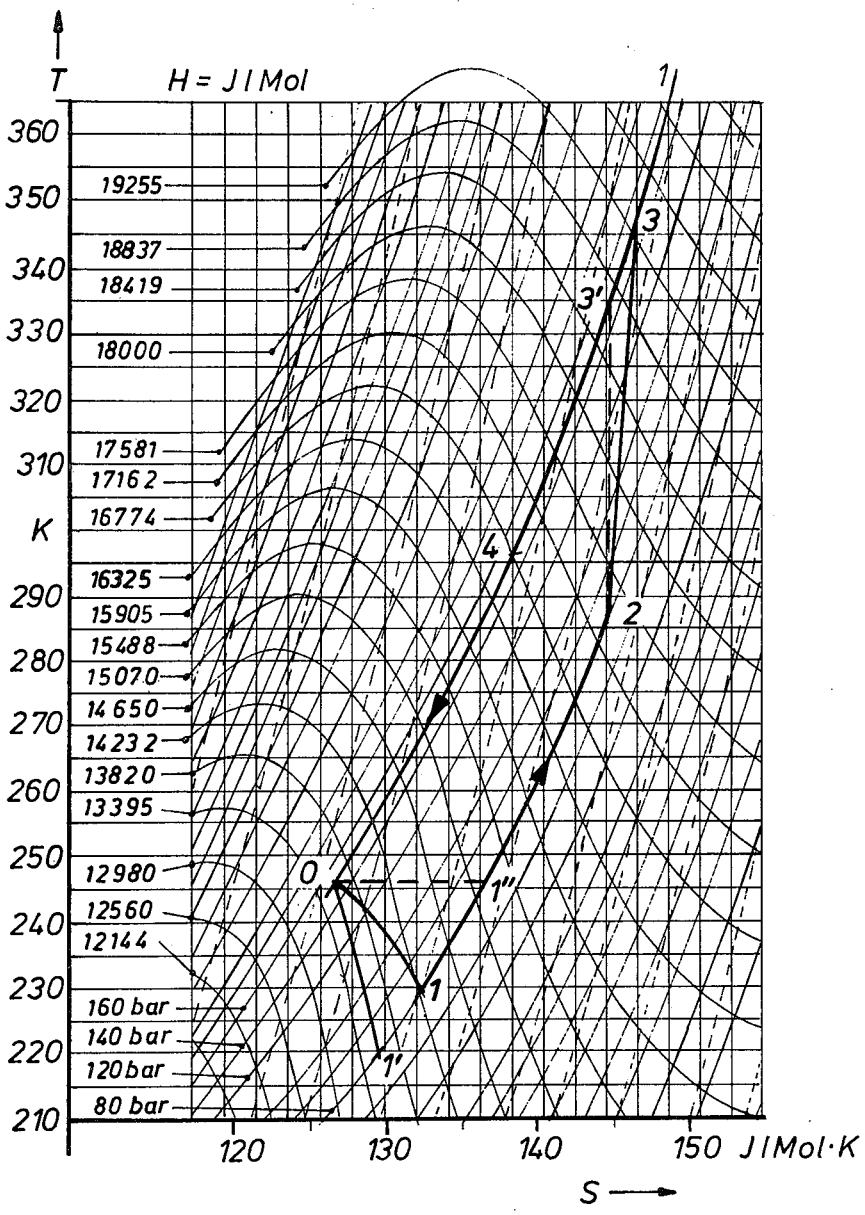
Figure 4:
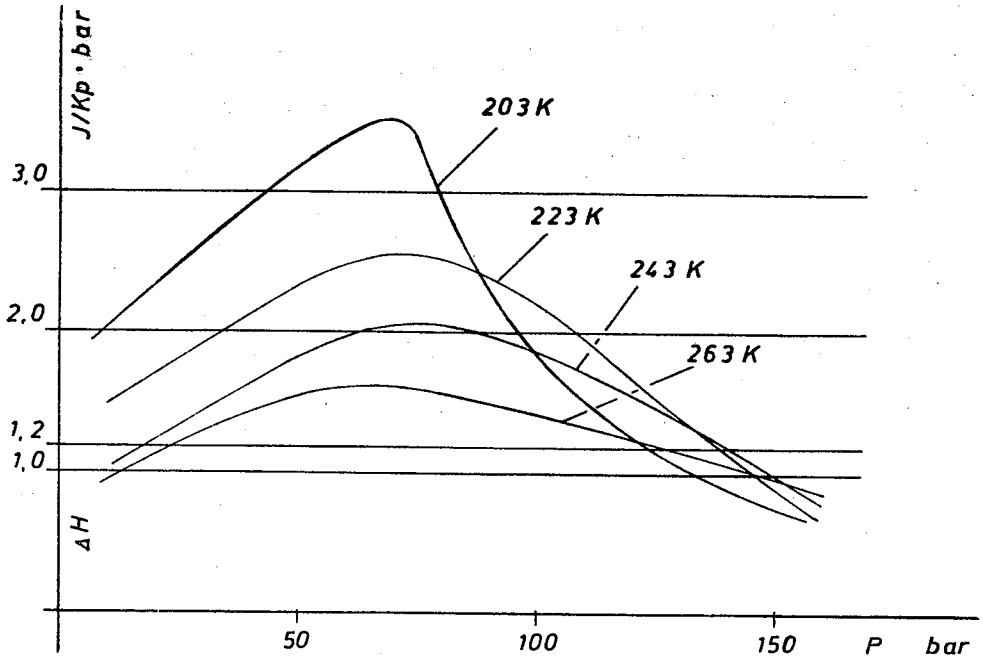
Figure 5:
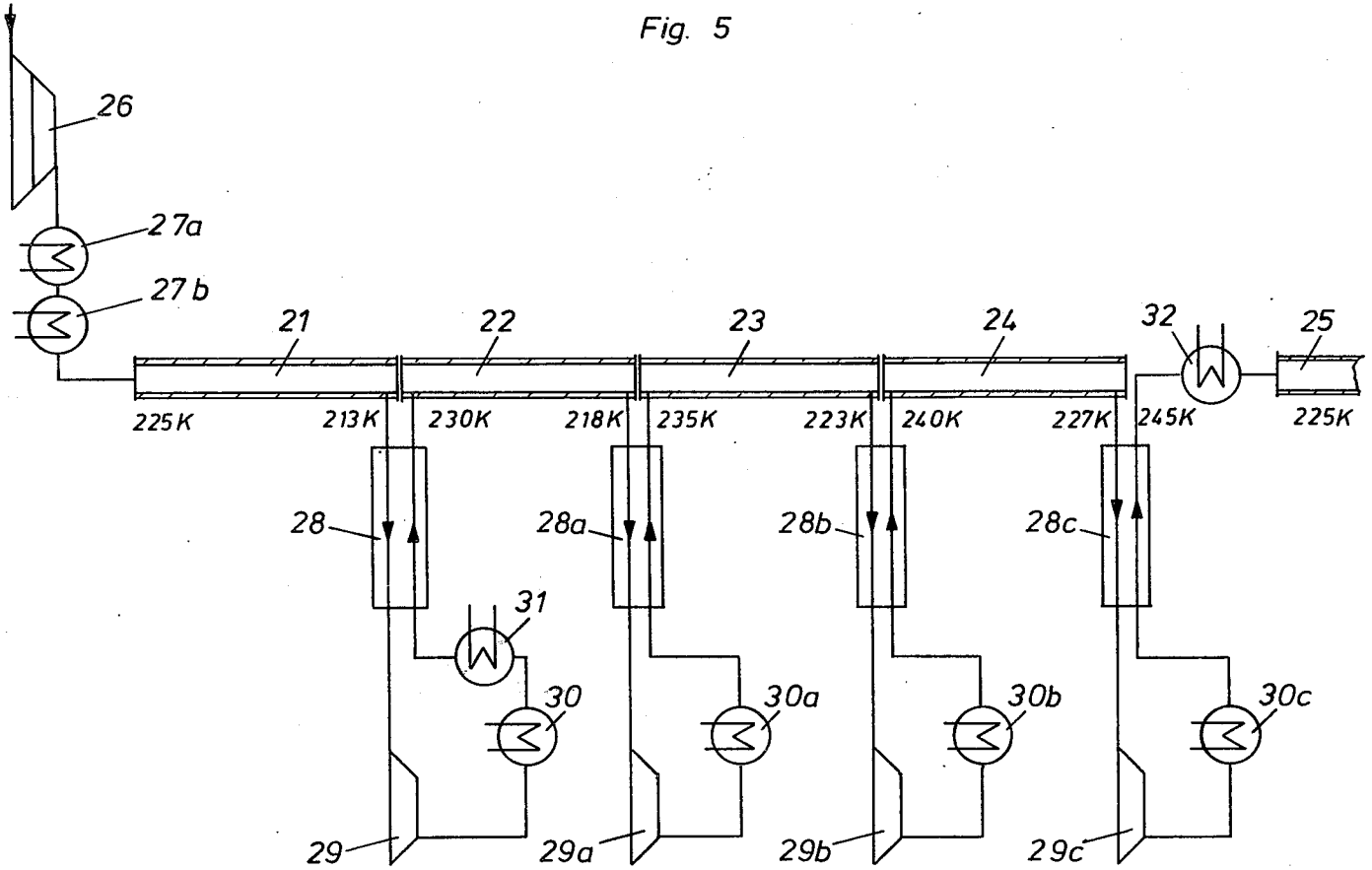
Figure 7:
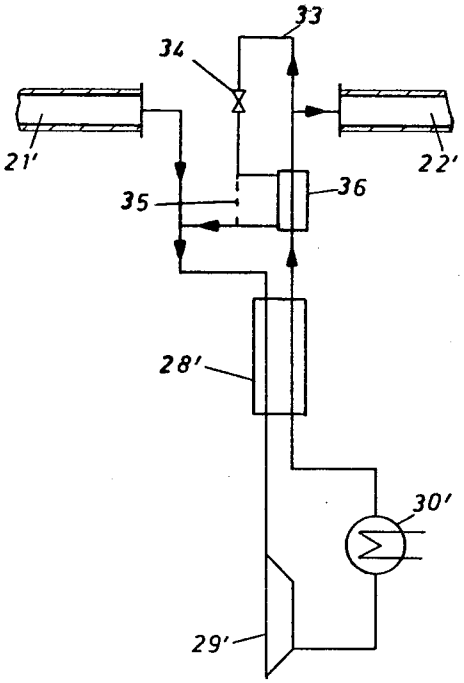
Figure 8:
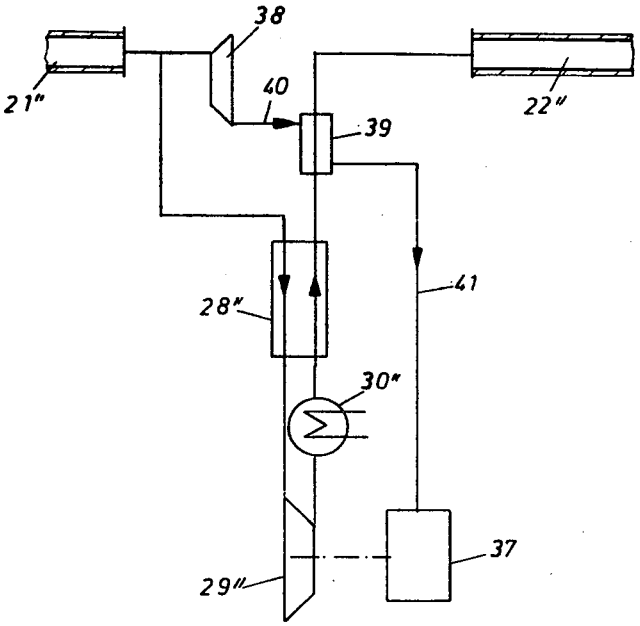

The invention may be performed in various ways and several embodiments with possible modifications will now be described by way of example with reference to the accompanying drawings in which:

FIG. 1 is a diagrammatic view of a first embodiment of a pipeline plant according to the invention, FIG. 2 shows a modification of the embodiment of FIG. 1, FIG. 3 is a T,s diagram for methane, FIG. 4 is a diagram which shows the enthalpy difference during pressure variation, FIG. 5 is a diagrammatic view of a further embodiment of a pipeline plant according to the invention, FIG. 6 is a temperature enthalpy diagram for the pipeline shown in FIG. 5, FIG. 7 is a diagrammatic view of an intermediate station with re-cooling of the gas entering one pipeline section and the admixture of a re-cooled partial current to the gas which is escaping from one pipeline section, and FIG. 8 is a diagrammatic view of an intermediate station with re-cooling of the gas by expanded supply gas.

Reference is first made to FIG. 1 in which are shown diagrammatically the frist and second pipeline sections 1 and 2 of a pipeline plant according to the invention. In this pipeline plant, the starting point is liquefied natural gas, which is conveyed by tankers to the beginning of a natural gas pipeline. The conveyance to the consumer occurs through a pipeline which is composed of pipeline sections, each 120 km in length, for example, between which compressor stations for compensating the pressure loss in the preceding pipeline section are provided. In FIG. 1 are shown two such pipeline sections 1 and 2, between which is located a compressor station 3. In this example the liquid natural gas from a heat-insulated tank 4, (which may alternatively be formed by the conveyance space of the tanker) is raised to high pressure, for example, 150 bars by means of a pump 5 and fed to an evaporator 6, which has a heating coil 7 through which flows warm water heated by a heat source 8. The natural gas leaves the evaporator 6 in the form of vapour, at a temperature of, for example, 243 K. and a pressure of 150 bars, and enters the first pipeline section in this state. The temperature of the vapour escaping from the evaporator 6 can naturally also be lower, for example, 223 K. or 203 K.

At the end 9 of this pipeline section 1, the gas, because of the friction losses, may have a pressure of only 80 bars, for example. As can be seen from the diagram of FIG. 3, this pressure loss of 150 bars to 80 bars during conveyance, without any heat supply from outside, along the isenthalpe $H=13.600$ J/Mol would produce a lowering of temperature to approximately 220 K.

As, however, no absolute insulation of the pipeline sections is possible, the outlet temperature of the gas at the end 9 of the first pipeline section 1 will in practice be roughly 228 K. The natural gas is now supplied to the compressor station 3, in which it is brought back to the initial pressure of 150 bars, and then supplied to the start of the second pipeline section 2. The compressor station 3 contains a counter-current heat exchanger 10, a compressor which, in the example, is a three-stage compressor 11, and a gas cooler 12. The gas arriving from the pipeline 1 flows at a pressure of 80 bars and a temperature of 228 K. into the counter-current heat exchanger 10, where by heat absorption from the gas heated by the compression, it is heated to 285 K., for example. In the compressor 11 there then occurs an increase in pressure from 80 bars to 150 bars with simultaneous heating of the gas to 348 K. Part of this heat of compression is removed from the gas in the gas cooler 12 which is, for example, supplied with water, so that the gas now enters the heat exchanger 10 at a temperature of, for example, 298 K. The temperature difference at the hot end of the heat exchanger 10 thus reaches 12°, which makes it possible to use a counter-current heat exchanger of economical dimensions. The gas now leaves the heat exchanger 10 at 243 K. and passes at the pressure of 150 bars into the second pipeline section 2. The temperature and pressure ratios at the start of the second pipeline section 2 are thus roughly the same as at the start of the first pipeline section 1. At the end 13 of the second pipeline section 2 there is again provided a compressor station corresponding to the compressor station 3, in order to produce roughly the same conditions upon entry of the gas into the next pipeline section as at the beginning of the first and the second pipeline section.

The pressures and temperatures stated are merely intended to serve as an example. The initial temperature of 243 K. at the beginning of each pipeline section has been selected bearing in mind the strength of materials which are available at present and can still be economically used.

Nevertheless, the specific volume at 243 K. and 100 bars is only roughly half of what it is at ambient temperature (293 K.) and atmospheric pressure, so that the conveying capacity of a given pipeline is doubled.

The pipeline, which is composed for example of columbium or tantalum alloy steel, is provided with heat insulation 14, which should be so designed that heat incidence from the surroundings is smaller than half the enthalpy figure which would be necessary to annul the temperature reduction. Such heat insulation can still be achieved with economically viable expenditure. It ensures that the temperature at the end of each pipeline section is sufficiently low to make possible re-cooling of the natural gas to the initial temperature before entry into the succeeding pipeline section without a refrigerating machine.

In FIG. 2 only the start of the first pipeline section 1*a* is shown, and here the starting point is not liquefied natural gas, as in the example of FIG. 1, but natural gas as it leaves a purification or separating plant 15. This natural gas is supplied, for example, to a four-stage compressor 16, and after flowing through an intermediate cooler 17, to a three-stage compressor 18 and is here compressed to the desired pressure of, for example, 150 bars. The gas is now cooled to a temperature of roughly 293 K. in a gas cooler 19 which is operated with water, for example, and finally brought to the desired initial temperature of, for example, 243 K. in a refrigerating machine 20. The natural gas therefore enters the first pipeline section at a temperature of 243 K. and a pressure of 150 bars, as in the exemplified embodiment of FIG. 1. The further conveyance of the natural gas takes place in the same way as in the exemplified embodiment as per FIG. 1.

When this plant is used to convey natural gas to a port, in which the gas has to be pumped into tankers in liquefied form, a liquefaction plant must be connected to the end of the last pipeline section, which plant, because of the fact that the gas leaves the pipeline at a very low temperature, for example, 228 K., can be comparatively small.

FIG. 3 shows the T,s diagram for methane, which natural gas contains at 90% by volume and more. The T,s diagrams of such methane-rich mixture are similar to one another and basically permit the same deductions. The examples mentioned hereafter relate to pure methane.

In this T,s diagram the course of the alteration in state of the gas according to the proposed process is shown by an example:

The gas enters under a pressure of 150 bars and at a temperature of 243 K. into the pipeline section at Point O and leaves it at Point 1 at 80 bars and 228 K. If the pipe were so thickly insulated that no heat from outside flows to the gas, the state of the gas would alter along an isenthalpe (H=13.600 J/Mol) towards Point 1'. If, on the other hand, the inflow of heat were so great that the change in state were to run isothermally towards Point 1'' (H=15.240 J/Mol), the heat to be supplied would be H=1.640 J/Mol=102 J/kp.

This quantity of heat would therefore be necessary in order to annul the temperature reduction from 246 K. to 228 K.

As a result of the insulation, the heat inflow is restricted. The actual gas state at the end of the pipeline at Point 1 is assumed, and only 630 J/Mol instead of 1.640 J/Mol—(i.e. less than half)—are supplied. The gas leaves this pipeline section and enters the counter-current heat exchanger of the compressor plant, where it is heated to 286 K. along the 80 bars isobar from Point 1 to Point 2, before it enters the compressor. With adiabatic compression, the temperature during compression from 80 bars to 150 bars would rise to 335 K. (Point 3'). Heating to 346 K. actually takes place along a polytrope to Point 3. In the gas cooler the temperature is lowered from Point 3 along an isobar to approx. 298 K. at Point 4, and from there in the counter-current heat exchanger to 243 K. (Point 0) at an entry temperature for the succeeding pipeline section.

In FIG. 4 is shown how the enthalpy H behaves at various temperatures with a lowering of pressure by 1 bar. In an ideal gas, the enthalpy does not vary with the pressure and the corresponding curve would coincide roughly with the X axis. Under temperature and pressure conditions which have to be considered with gas conveyance, however, in which the methane is a superheated vapour, the Van der Waal's cohesion forces play a very great part and require considerable quantities of energy which have the effect of altering the enthalpy, in order to overcome the attraction forces between the molecules. The curves for the respective temperature parameter run higher, the lower the gas temperature. The greater the enthalpy reduction, the more the gas cools during conveyance in the insulated pipeline. It can be seen from FIG. 4 that optimal prerequisites in the pressure range in question exist, if the enthalpy alteration reaches more than 1.2 J/kp. bar.

In the exemplified embodiment as per FIG. 5, a pipeline which is composed of five pipeline sections 21, 22, 23, 24 and 25, and is for the conveyance of natural gas, is shown. The natural gas coming from a separating plant behind a natural gas source is brought by means of a compressor 26 to a pressure of, for example, 120 bars and cooled to a temperature of, for example, 225 K. by means of a water cooler **27*a* and a cooler 27*b*, which is operated by a refrigerating machine. At this pressure and this temperature, the natural gas enters the pipeline section 21. At the end of the pipeline section 21 the gas, on account of friction losses, has a pressure of, for example, 80 bars. This pressure reduction would produce a lowering of the temperature to about 210 K. in a heat-tight pipe. As, however, no complete insulation of the pipeline sections is possible, the outlet temperature of the gas at the end of the first pipeline section 21 will in practice be approximately 213 K. The natural gas is now supplied via a counter-current heat exchanger 28 to a compressor 29, in which the gas is again brought to a pressure of 120 bars. After flowing through a first cooler 30 which is operated with industrial water (underground water or water which is recycled) and if necessary, a second cooler 31 which is operated with cold water (approx. 268–273 K.) or with vaporized refrigerating agent, the gas enters the counter-current heat exchanger 28 at a temperature of about 218 K and leaves it at a temperature of 230 K. This temperature is 5° higher than the temperature at which the gas enters the pipeline section 21. The temperature difference in the heat exchanger 28 is 17° here, whereby the dimensions of the heat exchanger 28 can be kept comparatively small. The gas therefore enters the pipeline section 22 at a pressure of 120 bars and a temperature of 230 K. At the end of the pipeline section 22, the gas will have a temperature of 218 K. at a pressure of 80 bars. As in the preceding intermediate station, the gas escaping from the pipeline section 22 is supplied through a counter-current (flow) device 28*a* to a compressor 29*a*, in which it is again brought to a pressure of 120 bars. After flowing through a cooler 30*a* which is operated with industrial water, the gas enters the heat exchanger 28*a* and leaves it at a temperature of 235 K. The gas, at the end of the pipeline section 23, once again has a pressure of 80 bars, whilst the temperature has fallen to 223 K. After increasing of the pressure in the compressor 29*b* and re-cooling in the cooler 30*b* and in the counter-current heat exchanger 28*b*, the gas at a pressure of 120 bars and a temperature of 240 K. enters the pipeline section 24, from which it escapes at 80 bars and a temperature of 227 K. In the intermediate station which now follows, the gas is brought back by the compressor 29*c* to the initial pressure of 120 bars and by the cooler 30*c* and the counter-current heat exchanger 28*c* to a temperature of 245 K, so that here also, there is a high temperature difference of 18° in the counter-current heat exchanger 28*c*. As this temperature for economical conveyance of the natural gas in the downstream-situated pipeline section 25 is relatively high, an additional cooler 32 is located between the heat exchanger 28*c* and the start of the pipepline section 25, which cooler is, for example, supplied by a refrigerating machine operated with the waste heat of the compressor 29*c*, and the temperature of the gas falls again to 225 K., for example, before it enters the pipeline section 25**.

The cold water cooler 31 in the first intermediate station is not absolutely necessary, but it reduces the dimensions of the counter-current heat exchanger 28. Such a cold water cooler could also be provided in the other intermediate stations. The re-cooler 32 in the exemplified embodiment of FIG. 5 is located in front of the fifth pipeline section 25. It could, however, also be omitted if suitable temperature conditions exist, or if required, could already be provided in an earlier intermediate station or even in each intermediate station.

In FIG. 5 the pipeline sections 21 to 25 are shown as being of equal length. In actual fact, the pipeline sections become shorter with rising temperature, if the drop in pressure in each pipeline section is to be of equal size.

The pressure and temperature conditions of the pipeline represented in FIG. 5 are shown in the diagram of FIG. 6, where the state (temperature T and enthalpy H) at the start of each pipeline section are indicated with $A_1 \ldots A_5$ and at the end of each pipeline section are indicated with $E_1 \ldots E_4$. $E_5$ would correspond to $E_1$.

The re-cooling of the gas by the cooler 32 before entry into the pipeline section 25 takes place from Point B (state during escape from the heat exchanger 28*c*) along the 120 bar line to Point $A_5$, whose coordinates are identical to those of $A_1$.

The state $E_o$ would arise at the end of the pipeline section 21 if the pipe were heat-tight, as the expansion of the gas along one isenthalpe would then take place. The size of the horizontal spacing of the Point $E_1$ from the vertical $A_1$–$E_o$ represents the estimated enthalpy gain as a result of the flowing-in of heat from outside through the insulation into the pipe.

A further measure for reducing the dimensions of the heat exchangers 28 . . . 28*c* by increasing the temperature difference in the heat exchangers consists of lowering the temperature of the gas flowing from the upstream-situated pipeline section into the heat exchanger. A simple posssibility of doing this is represented in FIG. 7. Here, a partial current is admixed with the gas which escapes from the pipeline section 21' before entry into the counter-current heat exchanger 28' through a branch pipeline 33 and a pipeline 35 which is indicated by dotted lines, which partial current is branched off from the re-cooled gas escaping from the heat exchanger 28'. This partial current flows through a throttle 34 in the branch pipeline 33. This throttle 34 produces by means of the Joule-Thompson effect a lowering of temperature in the partial current, so that the latter, at a lower temperature, is admixed with the gas which escapes from the pipeline section 21'. Through the greater temperature difference of 25°, for example, the counter-current heat exchanger 28' can be considerably reduced as compared with the exemplified embodiment of FIG. 5.

Instead of the throttle 34, a refrigerating machine can obviously also be used, if this is more advantageous for economic reasons.

Another possibility of increasing the temperature difference in the heat exchanger 28' which is indicated in FIG. 7 is the arrangement of a cooler 36 between the heat exchanger 28' and the start of the downstream-situated pipeline section 22'. This cooler 36 is charged by the branched partial current after flowing through the throttle 34. As a result of this re-cooling of the gas, its temperature of entry into the heat exchanger 28' originating from the compressor 29' may be higher than in the exemplified embodiment as per FIG. 5, whereby the temperature difference in the heat exchanger is raised and its dimensions are reduced.

In the exemplified embodiment as per FIG. 8, just as in FIG. 7, a cooler 39 is located between the heat exchanger 28'' and the downstream-situated pipeline section 22''. The compressor 29'' is here driven by a gas turbine 37, which obtains its supply gas from the upstream-situated pipeline section 21''. This supply gas is firstly conveyed through an expansion machine 38, in which the pressure is reduced from, for example, 80 bars to 3 bars, the temperature being simultaneously lowered from 230 K. to 150 K., for example. In this state, the partially liquefied supply gas is supplied through a pipeline 40 to the cooler 39, in which it cools the gas originating from the heat exchanger 28'' by heat absorption. The supply gas, which is now gaseous again, passes through the pipeline 41 to the gas turbine 31.

Instead of the expansion machine 38, a throttle could basically also be used.

I claim:

1. A method of conveying real gases over long distances by means of a pipeline having a plurality of sections connected in series by; providing between said sections one or more compressor stations to compensate for the pressure loss in the preceding pipeline section, controlling the pressure and temperature of the gas at the start of each pipeline section so that a lowering of gas temperature results from the Joule-Thompson effect created by the drop in pressure in the pipe section, and using this low temperature gas for re-cooling the gas heated by compression at one of said compressor stations, before entry into the next pipeline section.

2. A method according to claim 1, in which conveyance of the gas takes place at an initial pressure of between 75 and 150 bars and at an initial temperature of below 263 K.

3. A method according to claim 1, in which the initial pressure and temperature of the gas upon entry into a pipeline section lie within a temperature-pressure range in which the enthalpy increase is greater than 1.2 J/kp. bar for each bar of pressure relaxation.

4. A method according to claim 1, in which the inlet temperature of the re-cooled gas at the start of each succeeding pipeline section is higher than the entry temperature of the gas at the start of the next upstream pipeline section.

5. A method according to claim 1, comprising the additional step of removing heat from the gas before entry into the succeeding pipeline section.

6. A method according to claim 1 comprising the additional step of having a partial current admixed with the gas after leaving one pipeline section and before heat absorption from the gas which is to be recooled, which partial current is branched off from the recooled gas and is cooled to below the temperature of the gas leaving the next upstream pipeline section.

7. A pipeline plant for conveying gas over long distances comprising; a plurality of pipeline sections connected in series with interposed compressor stations, a counter-current heat exchanger associated with each compressor station, one part of said heat exchanger being located between the outlet end of one pipeline section and the inlet point of said compressor, and another part being located between the outlet point of the compressor and the start of the succeeding pipeline section and in operation said compressor stations compensate for pressure loss in the pipeline section preceding said stations and counter-current heat exchanger facilitiates the use of the low temperature gas from the outlet end of the pipeline preceding said exchanger to cool the higher temperature gas heated by compression going to the succeeding pipeline section.

8. A pipeline plant according to claim 7, including a gas cooler located between the outlet point of said compressor and said heat exchanger.

9. A pipeline plant according to claim 7, in which said compressor has a pressure ratio of at least 1.8.

10. A pipeline plant according to claim 7, in which at least some of the pipeline sections are provided with heat insulation, which is so designed that the heat incidence is smaller than half the enthalpy figure which would be necessary to annul the temperature drop.

11. A pipeline plant according to claim 7, in which at least some of the pipeline sections have an increasing cross-section with increasing length.

12. A pipeline plant according to claim 11, in which several pipes are connected in parallel to increase the cross-section.

13. A pipeline plant according to claim 7, including an evaporator of liquefied gas located upstream of the first pipeline section.

14. A pipeline plant according to claim 7, including a gas liquefaction plant connected to the end of last pipeline section.

15. A pipeline plant according to claim 7, including a refrigerating machine located between one heat exchanger and the downstream pipeline section.

16. A pipeline plant according to claim 7 in which a pipe connects the heat exchanger to the start of the next pipeline section communicates through a branch pipe with a pipe which connects the end of the preceding pipeline section to the heat exchanger, and a throttle is provided in this branch pipe to produce lowering of temperature by means of the Joule-Thompson effect.

17. A pipeline plant according to claim 7, including a normal water operated cooler and a cold water cooler connected between the compressor of each compressor and the heat exchanger.

18. A pipeline plant according to claim 7, including a cooler between one heat exchanger and the downstream pipeline section, the cooling medium being branched off from the gas leaving the cooler, and controlled by a throttle in order to produce lowering of the temperature.

19. A pipeline plant according to claim 7, in which the compressor of at least one station is driven by a gas turbine, and between the heat exchanger and the downstream pipeline section there is located a cooler whose cooling medium is a partial current of the gas which leaves the upstream pipeline section, and into whose inflow pipeline to the cooler an expansion machine, a throttle or similar temperature and pressure-reducing device is connected, and whose outflow pipeline from the cooler is connected to the gas turbine.

* * * * *